US010113475B2

(12) United States Patent
Kennedy et al.

(10) Patent No.: US 10,113,475 B2
(45) Date of Patent: Oct. 30, 2018

(54) SHUNT TANK ASSEMBLY

(71) Applicant: Caterpillar Inc., Peoria, IL (US)

(72) Inventors: Joseph L. Kennedy, Peoria, IL (US); Neil Terry, Edelstein, IL (US)

(73) Assignee: Caterpillar Inc., Deerfield, IL (US)

( * ) Notice: Subject to any disclaimer, the term of this patent is extended or adjusted under 35 U.S.C. 154(b) by 446 days.

(21) Appl. No.: 14/938,158

(22) Filed: Nov. 11, 2015

(65) Prior Publication Data

US 2017/0130641 A1 May 11, 2017

(51) Int. Cl.

| | |
|---|---|
| ***F01P 11/02*** | (2006.01) |
| ***B65D 6/40*** | (2006.01) |
| ***B65D 90/22*** | (2006.01) |
| ***F01P 11/04*** | (2006.01) |

(52) U.S. Cl.

CPC ..... *F01P 11/028* (2013.01); *F01P 11/029* (2013.01); *F01P 11/04* (2013.01)

(58) Field of Classification Search

CPC ..... F01P 11/02; F01P 11/0204; F01P 11/028; F01P 11/0285; F01P 11/029

See application file for complete search history.

(56) References Cited

U.S. PATENT DOCUMENTS 6,223,793 B1 * 5/2001 Donoughe ..... B60S 1/50 141/331

8,851,026 B2 10/2014 Brinkmann et al.

FOREIGN PATENT DOCUMENTS

| | | |
|---|---|---|
| CN | 2055866 | 4/1990 |
| CN | 201106480 | 8/2008 |
| KR | 2002016039 | 3/2002 |
| KR | 552204 | 2/2006 |
| WO | 2014092843 | 6/2014 |

* cited by examiner

*Primary Examiner* — Andrew T Kirsch

(57) ABSTRACT

A shunt tank assembly for a cooling system is provided. The shunt tank assembly includes a vent tube, a shunt tank, and an inlet port provided on the shunt tank. The inlet port is in fluid communication with the vent tube. The shunt tank assembly also includes an insert disposed in the inlet port. The shunt tank assembly further includes a drop tube. The drop tube includes a plug portion having a first length and received within the insert. The drop tube includes a transition portion tapered with respect to the plug portion. The drop tube includes a tube portion extending from the transition portion and terminating with a chamfered end. The tube portion has a second length greater than the first length of the plug portion. The tube portion is bent such that the chamfered end is disposed below an average coolant level of the shunt tank.

18 Claims, 6 Drawing Sheets

SHUNT TANK ASSEMBLY

TECHNICAL FIELD

The present disclosure is related to a cooling system for an engine, and more particularly to a shunt tank assembly in the cooling system.

BACKGROUND

Engines used in power generation or heavy machinery applications include a cooling system. The cooling system includes a radiator, a coolant pump, a thermostat, and a shunt tank assembly. The coolant pump is used to recirculate a coolant through the radiator and the engine. The coolant is used to dissipate heat form the engine and the radiator is used to dissipate heat from the coolant to the ambient. Further, the thermostat is used to regulate a flow of the coolant into the radiator. Furthermore, the shunt tank assembly is used for storing the coolant while compensating a change in the volume due to the thermal expansion. The shunt tank assembly includes a shunt tank and an engine coolant conduit connected between the shunt tank and the engine. The shunt tank compensates any change in volume of coolant within the cooling system by providing additional storage.

U.S. Pat. No. 8,851,026 discloses a cooling arrangement for an internal combustion engine. The cooling arrangement includes a shunt tank which is capable of being filled with coolant. The inlet side of the shunt tank is connected via a first venting line to an internal combustion engine and/or a second venting line to a radiator for cooling the coolant. The outlet side of the shunt tank is connected via a coolant return line to the inlet side of a coolant pump. The cooling arrangement has, furthermore, a flow control unit for controlling the coolant volume flow in the venting line.

SUMMARY OF THE DISCLOSURE

In one aspect of the present disclosure, a drop tube for a shunt tank is disclosed. The drop tube defines a channel along a central axis therethrough. The drop tube includes a plug portion having a first length. The drop tube includes a flange provided at a first end of the plug portion. The drop tube also includes a transition portion provided at a second end of the plug portion. The transition portion is tapered with respect to the plug portion. The drop tube further includes a tube portion extending from the transition portion and terminating with a chamfered end. The tube portion has a second length greater than the first length of the plug portion. Further, the tube portion is made of elastomeric material configured to bend without kinking.

In another aspect of the present disclosure, a shunt tank assembly for a cooling system is provided. The shunt tank assembly includes a shunt tank. The shunt tank assembly also includes an inlet port provided on the shunt tank. The inlet port is in fluid communication with a vent tube. The shunt tank assembly also includes an insert disposed in the inlet port. The shunt tank assembly further includes a drop tube. The drop tube includes a plug portion having a first length and received within the insert. The drop tube includes a transition portion provided at a second end of the plug portion. The transition portion is tapered with respect to the plug portion. The drop tube also includes a tube portion extending from the transition portion and terminating with a chamfered end. The tube portion has a second length greater than the first length of the plug portion. The tube portion is bent such that the chamfered end is disposed below an average coolant level of the shunt tank.

In yet another aspect of the present disclosure, a method of preventing aeration in a cooling system. The method includes providing a shunt tank assembly within the cooling system. The method includes connecting a vent tube and an inlet port of the shunt tank assembly for fluid communication with the cooling system. The method includes inserting an insert in the inlet port. The method includes placing a drop tube in the insert for fluid communication of the drop tube with the vent tube. The method also includes bending a tube portion of the drop tube such that a chamfered end of the tube portion is disposed below an average coolant level of a shunt tank. The method further includes allowing a coolant to flow via the chamfered end of the drop tube to prevent aeration of the cooling system.

Other features and aspects of this disclosure will be apparent from the following description and the accompanying drawings.

DETAILED DESCRIPTION

Reference will now be made in detail to specific embodiments or features, examples of which are illustrated in the accompanying drawings. Wherever possible, corresponding or similar reference numbers will be used throughout the drawings to refer to the same or corresponding parts.

Figure 1:
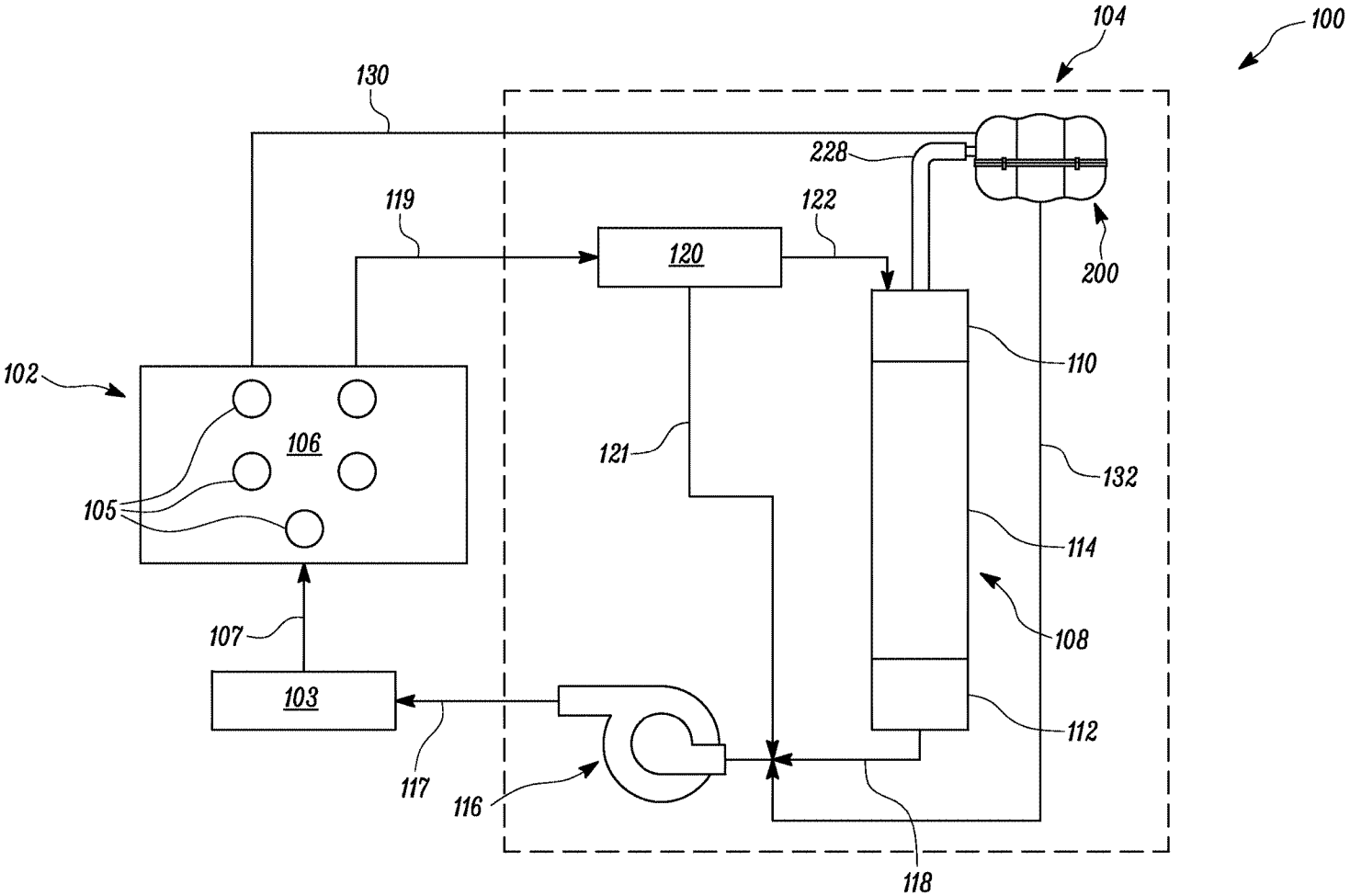
FIG. 1 is a schematic view of an engine system.

FIG. 1 illustrates a schematic view of an exemplary engine system 100. The engine system 100 may be used in various types of machines associated with industries including, but not limited to, transportation, construction, mining, agriculture, forestry, waste management, and material handling. In an embodiment, the engine system 100 may be used to power a machine, for example a backhoe loader, an excavator, and the like. In another embodiment, the engine system 100 may also be operably coupled to a power conversion device (not shown), such as a generator, to generate electric power.

The engine system 100 includes an engine 102 and a cooling system 104 associated with the engine 102. The engine 102 may be an internal combustion engine. The engine 102 may be a spark ignition engine or a compression ignition engine, such as, a diesel engine, a homogeneous charge compression ignition engine, or a reactivity controlled compression ignition engine, or other compression ignition engines known in the art. The engine 102 may be configured to operate on fuels such as gasoline, diesel fuel, biodiesel, alcohol, natural gas or a combination thereof. The engine 102 may be of multi-cylinder type, or a singlecylinder engine. Moreover, the engine 102 may be of a V-type configuration, an in line configuration, or a radial configuration. A person having ordinary skill in the art will appreciate that embodiment of the present disclosure may be beneficially implemented in various types of engines commonly known in the art without deviating from the spirit of the present disclosure.

The cooling system 104 is configured to cool the engine 102 by circulating a coolant through the engine 102. Specifically, the cooling system 104 circulates the coolant through one or more fluid passages 105 defined in an engine block 106 of the engine 102. Thus, the coolant is configured to absorb heat from one or more components of the engine 102. In an embodiment, the coolant may be a mixture of water and an antifreeze solution, wherein the antifreeze solution may include ethylene glycol or propylene glycol.

The cooling system 104 includes a radiator 108, a coolant pump 116 fluidly connected with the radiator 108, a thermostat 120 to regulate a flow of the coolant to the radiator 108, and a shunt tank assembly 200 used for storing the coolant while compensating for a increase in volume of the coolant due to the thermal expansion.

In an embodiment, the radiator 108 includes an inlet manifold 110, an outlet manifold 112, and a heat exchanger portion 114 disposed between the inlet manifold 110 and the outlet manifold 112. The heat exchanger portion 114 is adapted to cool the coolant received from the inlet manifold 110 and supply the coolant to the outlet manifold 112. In an embodiment, the heat exchanger portion 114 may include multiple radiator tubes (not shown) structured and arranged therein to allow heat transfer between the coolant flowing through the radiator tubes and the ambient. Moreover, a fan (not shown) may also be provided to create air flow through the heat exchanger portion 114 to dissipate heat by forced convection.

The coolant pump 116 is connected to the outlet manifold 112 of the radiator 108 by a coolant pump conduit 118. The coolant pump 116 is configured to supply the coolant from the outlet manifold 112 of the radiator 108 to the engine 102 via an oil cooler 103. The coolant pump 116 is further connected to an oil cooler conduit 117 adapted to supply the coolant to the oil cooler 103. The coolant pump 116 may be any type of known positive displacement pump or rotodynamic pump such as centrifugal pumps, mixed flow pumps, axial pumps and the like.

The oil cooler 103 is configured to cool a lubricating oil associated with the engine 102 by exchanging heat with coolant received from the coolant pump 116. The oil cooler 103 may also include multiple cooling tubes (not shown) that allow a passage of the coolant therethrough in order to exchange heat and thereby cool the lubricating oil. In the illustrated embodiment, an oil cooler conduit 107 is connected between the engine 102 and the oil cooler 103. The oil cooler conduit 107 is configured to supply the coolant to the engine 102.

The thermostat 120 is connected to the inlet manifold 110 of the radiator 108, the coolant pump 116 and the engine 102. The thermostat 120 is configured to receive a flow of coolant from the engine 102, via an engine conduit 119, and supply to the coolant pump 116 via a first thermostat conduit 121. The thermostat 120 is also configured to control the flow of coolant from the engine 102 to the inlet manifold 110 of the radiator 108 based on a temperature of the coolant flowing through the thermostat 120. In response to the temperature of the coolant flowing through the thermostat 120, the thermostat 120 selectively directs the flow of coolant from the engine 102 to the radiator 108 via a second thermostat conduit 122.

The thermostat 120 may be actuatable between a first position which allows all the coolant flow to the coolant pump 116, and a second position which allows a partial coolant flow to each of the coolant pump 116 and the inlet manifold 110. The thermostat 120 may be in the first position when a temperature of coolant received from the engine 102 is less than a predetermined temperature. The thermostat 120 may be in the second position when the temperature of the coolant received from the engine 102 is greater than the predetermined temperature. The thermostat 120 may include a sensing unit (not shown) that detects the temperature of the coolant flowing therethrough. In an embodiment, the sensing unit may be a wax element. In various alternate embodiments, the sensing unit may be thermocouples, bimetallic mechanical or electrical sensors, thermistors or any other semiconductor devices.

Referring to FIG. 1, the shunt tank assembly 200 is configured to provide a reservoir of the coolant associated with the cooling system 104. The shunt tank assembly 200 is disposed in fluid communication with the cooling system 104 such that the shunt tank assembly 200 provides an overflow compartment for compensating a change in the volume of the coolant due to the temperature increase during operation of the engine system 100. In the illustrated embodiment, the shunt tank assembly 200 is connected to the engine 102 by an engine coolant conduit 130. The shunt tank assembly 200 is also connected to the coolant pump 116 by an outlet conduit 132. The outlet conduit 132 is adapted to supply a flow of coolant from the shunt tank assembly 200 to the coolant pump 116 during operation of the engine system 100. In an embodiment, the shunt tank assembly 200 may be placed at a position having a potential gradient greater than the potential gradient of other components of the cooling system 104.

The shunt tank assembly 200 is connected to a vent tube 228. The vent tube 228 is connected between the shunt tank assembly 200 and the inlet manifold 110 of the radiator 108. The vent tube 228 may be a tubular member made of a non-metallic material, such as plastic material, adapted to allow the coolant to flow therethrough. The vent tube 228 is adapted to transfer a flow of coolant between the inlet manifold 110 of the radiator 108 and the shunt tank assembly 200 based on the positions of the thermostat 120. When the thermostat 120 is in the first position, the vent tube 228 transfers the coolant from the shunt tank assembly 200 to the inlet manifold 110 of the radiator 108. Further, when the thermostat 120 is in the second position, the vent tube 228 receives a flow of coolant from the radiator 108 and supplies to the shunt tank assembly 200.

Figure 2:
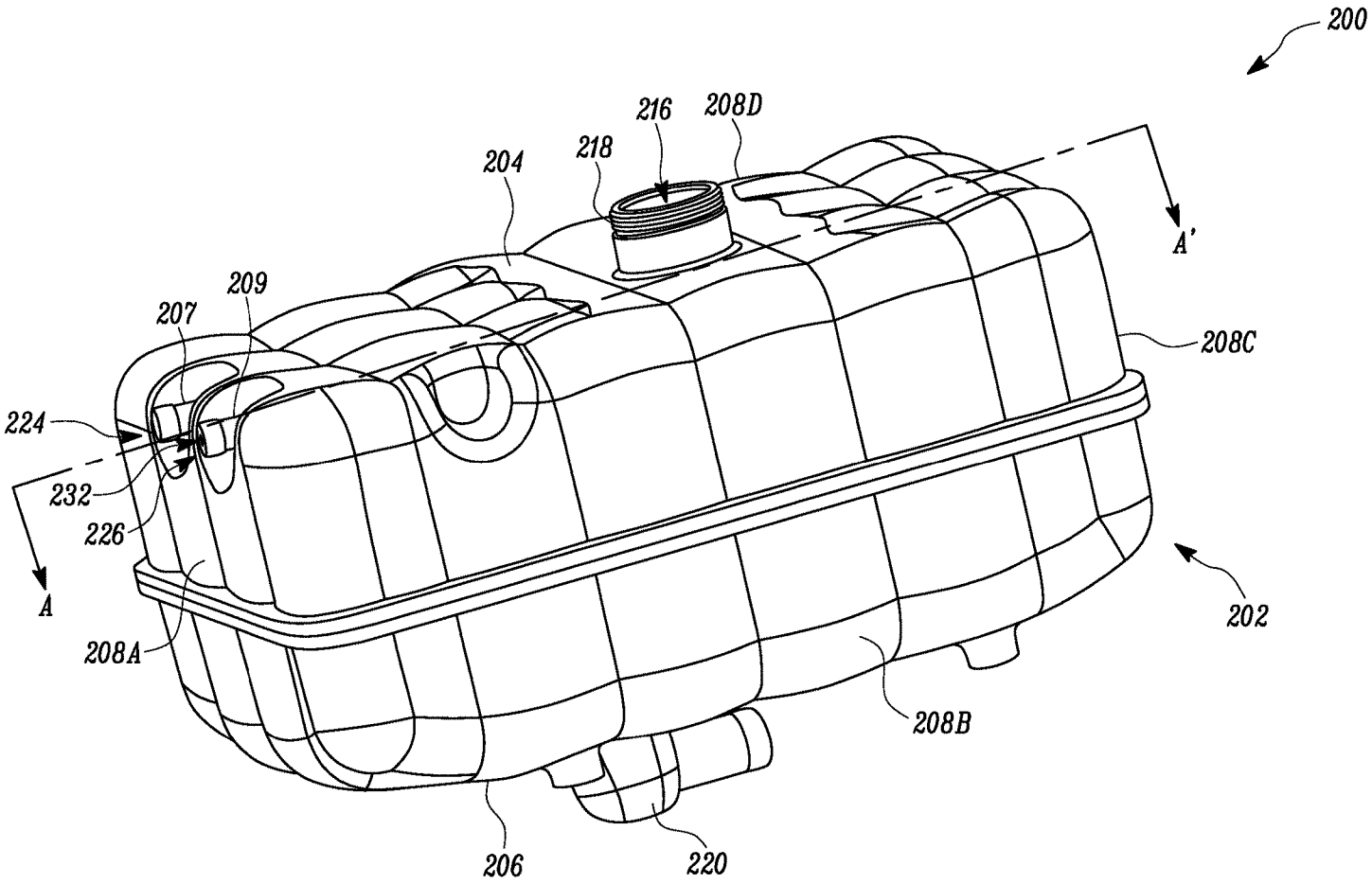
FIG. 2 is a perspective view of a shunt tank assembly in the engine system, according to an embodiment of the present disclosure.
Figure 3:
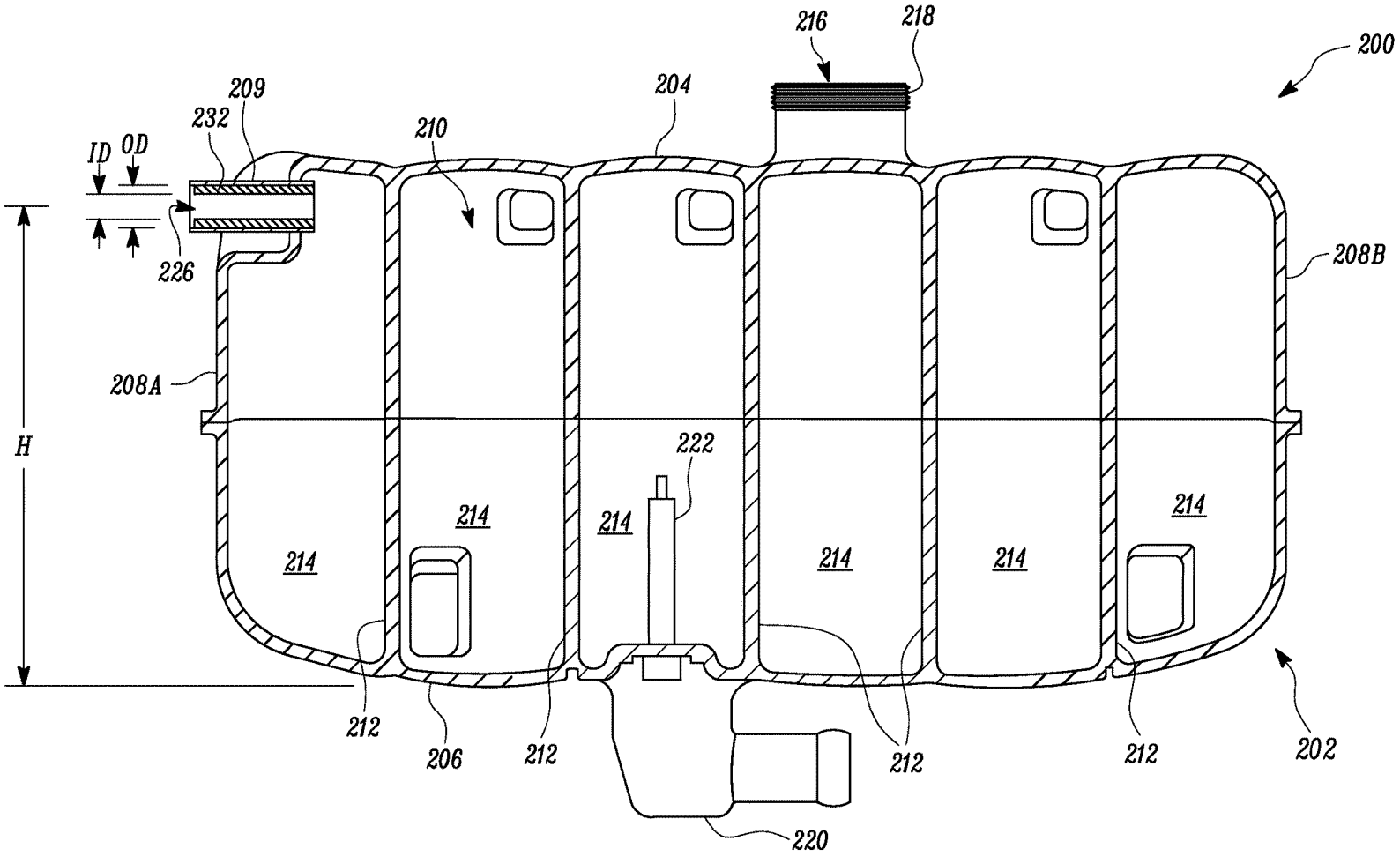
FIG. 3 is a sectional view of the shunt tank assembly of FIG. 2 taken along a line A-A'.

Referring to FIGS. 2 and 3, wherein the FIG. 2 is a perspective view of the shunt tank assembly 200, and FIG. 3 is a sectional view of the shunt tank assembly 200 of FIG. 2 taken along a line A-A', the shunt tank assembly 200 includes a shunt tank 202. The shunt tank 202 is a closed container having a top wall 204 and a bottom wall 206 spaced apart from the top wall 204. The shunt tank 202 also includes a plurality of side walls 208A, 208B, 208C, and 208D, extending between the top wall 204 and the bottom wall 206. The top wall 204, the bottom wall 206, and the side walls 208A, 208B, 208C, 208D (shown in FIG. 2) are structured and arranged to define a reservoir portion 210 (shown in FIG. 3).

The reservoir portion 210 receives a flow of coolant from the engine 102, via the engine coolant conduit 130, (see FIG.

1) and is configured to store the coolant therein. Further, a coolant level within the reservoir portion 210 may vary depending on the first position and the second position of the thermostat 120. Therefore, based on a design and an application of the engine system 100, an average coolant level of the shunt tank 202 may also be defined. In an embodiment, the average coolant level may be defined based on a highest coolant level associated with high idling condition of the engine 102, and a lowest coolant level associated with the low idling condition of the engine 102. In an alternate embodiment, the average coolant level may be defined based on a volumetric capacity of the shunt tank 202.

Referring to FIG. 3, the shunt tank 202 also includes multiple connecting walls 212 dividing the reservoir portion 210 into a number of compartments 214. In the illustrated embodiment, the shunt tank 202 includes five connecting walls 212 dividing the reservoir portion 210 into six compartments 214. Each of the connecting walls 212 includes one or more holes (not shown) defined therein. The holes allow the coolant to flow between the compartments 214 of the reservoir portion 210.

In an embodiment, the shunt tank 202 may be made of a non-metallic material, for example, a plastic material or any other suitable composition of materials capable of storing the coolant therein.

The shunt tank 202 further includes an opening 216 defined by the top wall 204. The opening 216 may be used to fill or refill coolant into the shunt tank 202 and in turn into the cooling system 104. The top wall 204 also includes a threading portion 218, such that the threading portion 218 extends from the top wall 204 to define the opening 216 therebetween. Further, a cap (not shown) may also be releasably coupled to the threading portion 218.

The shunt tank 202 further includes a flange portion 220 defined on the bottom wall 206. The flange portion 220 is connected to the coolant pump 116 by the outlet conduit 132 (see FIG. 1). The shunt tank 202 also includes a venting conduit 222. The venting conduit 222 extends from the flange portion 220 into the reservoir portion 210.

Referring to FIG. 2, the shunt tank 202 further includes a vent port 224 defined by a first projecting portion 207 of the sidewall 208A. However, in various embodiments, the vent port 224 may be defined on at least one of the sidewalls 208A, 208B, 208C, and 208D of the shunt tank 202. The vent port 224 is disposed in a fluid communication with the reservoir portion 210 and the engine 102. The vent port 224 is configured to receive the flow of coolant from the engine 102 and supply the flow of coolant to the reservoir portion 210. The vent port 224 is coupled to the engine coolant conduit 130 (see FIG. 1), which is configured to supply a flow of coolant from the engine 102 to the shunt tank 202. Though, in the illustrated embodiment, the vent port 224 has a circular shape, in various alternate embodiments, the vent port 224 may be of a rectangular shape, an elliptical shape, and the like.

Referring to FIGS. 2 and 3, the shunt tank assembly 200 also includes an inlet port 226 provided on the shunt tank 202. In the illustrated embodiment, the inlet port 226 is defined by a second projecting portion 209 of the sidewall 208A. In an alternative embodiment, the inlet port 226 may be defined by a portion of tube (not shown) coupled to at least one of the sidewalls 208A, 208B, 208C, and 208D of the shunt tank 202. In such a case, a hole (not shown) may also be provided on the sidewall to fluidly connect the reservoir portion 210 and the inlet port 226. Further, the inlet port 226 is disposed at a height "H" (shown in FIG. 3) from the bottom wall 206. The height "H" is greater than the average coolant level of the shunt tank 202.

The inlet port 226 is connected to the vent tube 228 (see FIG. 1) by coupling the second projecting portion 209 and the vent tube 228. The second projecting portion 209 may be connected to the vent tube 228 by various methods, such as welding, and fastening, and the like. In an embodiment, an outer diameter of the second projecting portion 209 may be slightly greater than an inner diameter of the vent tube 228 such that a snap fit may be obtained therebetween.

As shown in FIG. 3, the shunt tank assembly 200 also includes an insert 232 disposed in the inlet port 226. The insert 232 may extend along a length less than or equal to a length of the inlet port 226. The insert 232 has an annular cross section defining an inner diameter 'ID' and an outer diameter 'OD'. In an embodiment, the outer diameter "OD" of the insert 232 may be slightly greater than an inner diameter of the inlet port 226 such that a transition fit may be obtained between the second projecting portion 209 and the insert 232.

Figure 4:
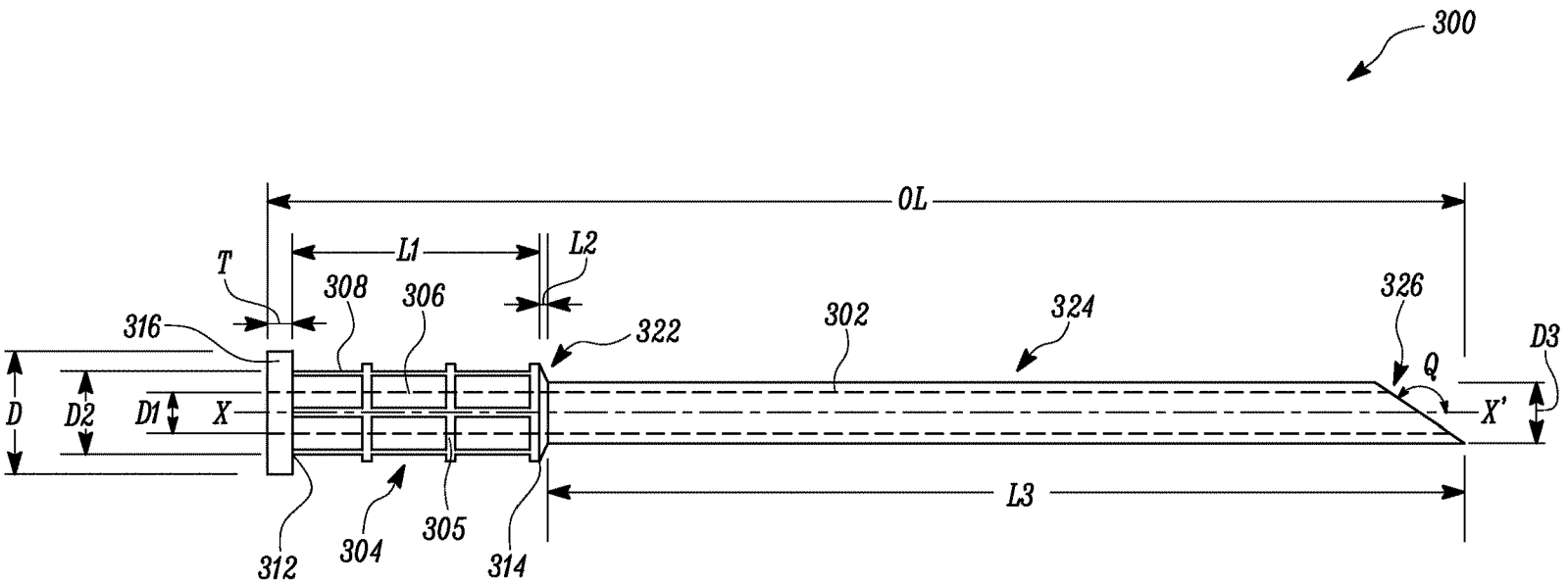
FIG. 4 is a front view of a drop tube of the shunt tank assembly, according to an embodiment of the present disclosure.
Figure 5:
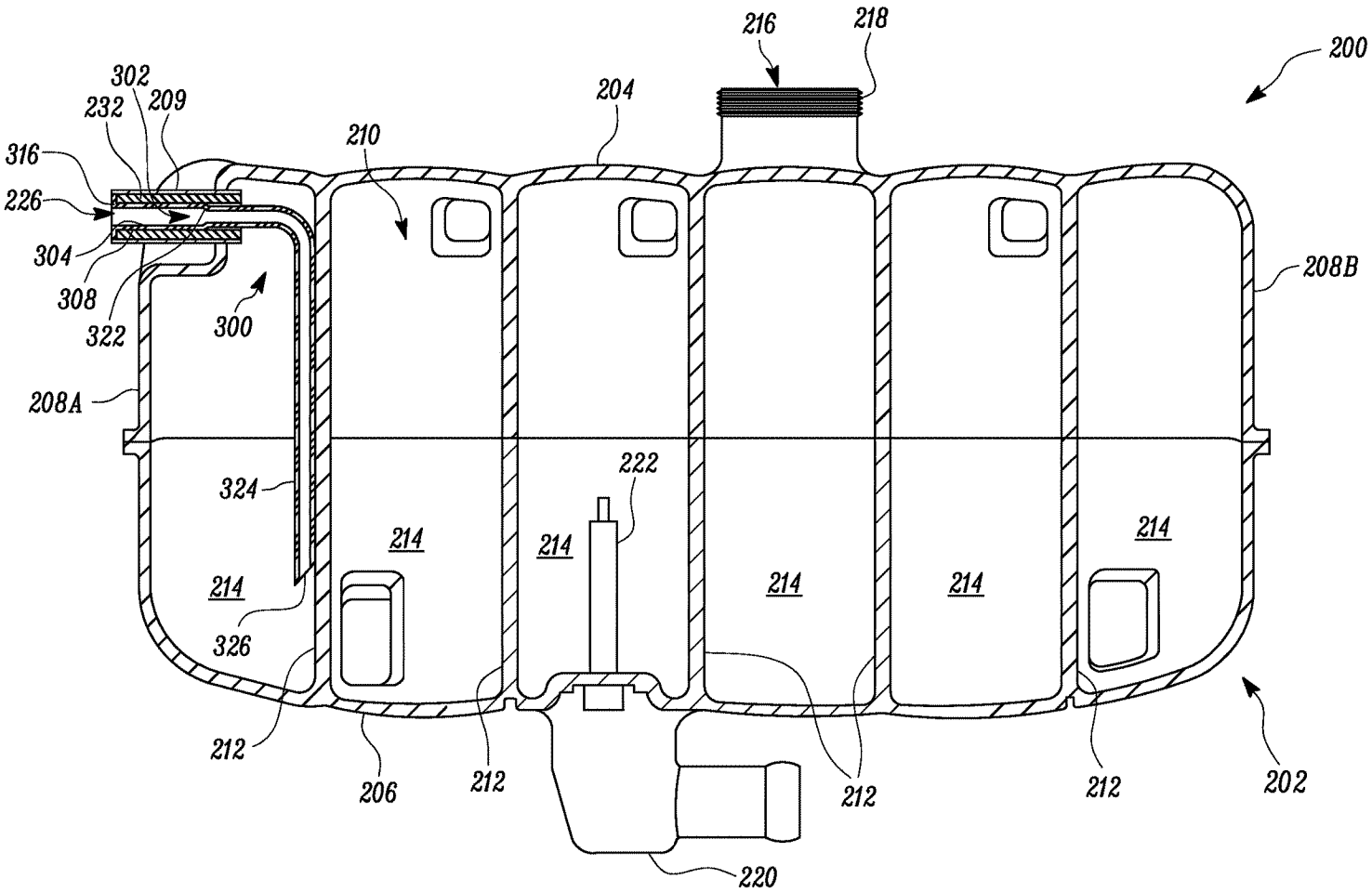
FIG. 5 is a sectional view of the shunt tank assembly of FIG. 2 having the drop tube of FIG. 4, according to an embodiment of the present disclosure.

FIG. 4 is a front view of a drop tube 300 of the shunt tank assembly 200, and FIG. 5 is a sectional view of the shunt tank assembly 200 having the drop tube 300. Referring to FIGS. 4 and 5, the shunt tank assembly 200 includes the drop tube 300. The drop tube 300 is disposed in fluid communication with the reservoir portion 210 of the shunt tank 202 and the vent tube 228 (see FIG. 1). In the illustrated embodiment, the drop tube 300 is partly received within the inlet port 226 of the shunt tank 202 to allow the coolant to flow therethrough during operation of the engine system 100. The drop tube 300 is configured to receive a flow of coolant from the reservoir portion 210 of the shunt tank 202 and supply to the vent tube 228. The drop tube 300 is also be configured to receive a flow of coolant from the radiator 108, via the vent tube 228, and supply to the flow of coolant to the reservoir portion 210.

It may be contemplated that the drop tube 300 may also be disposed within the vent port 224 of the shunt tank 202 to supply a flow of coolant from the engine 102 to the shunt tank assembly 200.

As shown in FIG. 4, the drop tube 300 defines a channel 302 extending along a central axis XX' therethrough. The channel 302 allows the coolant to flow through the drop tube 300. The channel 302 has a channel diameter 'D1' and extends along an overall length 'OL' of the drop tube 300. In the illustrated embodiment, the channel diameter 'D1' is uniform along the overall length 'OL'. In various alternate embodiments, the channel diameter 'D1' may vary along the overall length 'OL'. For example, the channel diameter 'D1' may vary between ¼ inches and 3/16 inches along the overall length 'OL'. In an embodiment, the diameter may vary with different segments of the overall length 'OL' of the drop tube 300.

The drop tube 300 includes a plug portion 304. The plug portion 304 is adapted to be received within the insert 232. The plug portion 304 is also adapted to abut the insert 232. The plug portion 304 is a cylindrical shaped member having a first outer diameter 'D2'. The first outer diameter 'D2' of the plug portion 304 may be equal to the inner diameter 'ID' (shown in FIG. 3) of the insert 232. Further, the plug portion 304 has a first length "L1". The first length "L1" corresponds to a distance between a first end 312 and a second end 314 of the plug portion 304.

The plug portion 304 may also include multiple web projections 305 provided on an outer surface 308 of the plug portion 304. The web projections 305 are adapted to engage with the insert 232 to tightly fit the plug portion 304 within the insert 232. It should be understood that the web projections 305, as shown, are purely exemplary and not intended to be limiting of the present disclosure. For example, in an alternate embodiment, the outer surface 308 of the plug portion 304 may also be a flat surface.

The drop tube 300 also includes a flange 316 provided at the first end 312 of the plug portion 304. In an embodiment, the flange 316 may be an integral member of the plug portion 304 provided at the first end 312 of the plug portion 304. In an alternative embodiment, the flange 316 may be an external member coupled to the first end 312 of the plug portion 304. The flange 316 is adapted to abut the insert 232 such that a movement of the plug portion 304 towards the reservoir portion 210 is restricted. Further, the flange 316 has a diameter 'D'. The flange 316 also defines a thickness 'T'. The thickness 'T' of the flange 316 may be varied based on requirements. In an embodiment, the thickness 'T' of the flange 316 may be 3/32 inches.

The drop tube 300 also includes a transition portion 322 extending from the second end 314 of the plug portion 304 along the central axis XX'. The transition portion 322 is tapered with respect to the plug portion 304. The transition portion 322 is an annular member having a diameter varying along a transition length 'L2' of the transition portion 322. The transition length 'L2' of the transition portion 322 may also be varied based on various requirements.

The drop tube 300 further includes a tube portion 324 partly received within the insert 232. The tube portion 324 is made of elastomeric material configured to bend without kinking. The tube portion 324 extends from the transition portion 322 and terminates with a chamfered end 326. The chamfered end 326 is inclined with respect to the central axis XX' at an angle 'Q'. The angle 'Q' may be selected based on the channel diameter 'D1'. In an embodiment, the angle 'Q' may be defined between 45 degrees to 60 degrees.

In the illustrated embodiment, the tube portion 324 is a cylindrical member having a second length 'L3'. The second length 'L3' of the plug portion 304 is greater than the first length 'L1' of the plug portion 304. In an embodiment, a ratio of the first length IF of the plug portion 304 and the second length 'L3' of the tube portion 324 is at least 1:6. The ratio between the first length 'L1' and the second length 'L2' may be selected such that the chamfered end 326 is disposed below the average coolant level of the shunt tank 202.

The tube portion 324 has a second outer diameter 'D3'. The second outer diameter 'D3' of the tube portion 324 is less than the first outer diameter 'D2' of the plug portion 304. In an embodiment, a ratio of the first outer diameter 'D2' of the plug portion 304 and the second outer diameter 'D3' of the tube portion 324 is at least 5:4. The ratio between the first outer diameter 'D2' and the second outer diameter 'D3' may be selected to form a transition fit between the tube portion 324 and the insert 232. Further, the second outer diameter 'D3' is also less than the diameter 'D' of the flange 316. A ratio of the diameter 'D' of the flange 316 and the first outer diameter 'D2' is at least 7:5. The ratio between the diameter 'D' of the flange 316 and the first outer diameter 'D2' of the plug portion 304 may be selected such that the flange 316 abuts the insert 232 to restrict the movement of the drop tube 300 towards the reservoir portion 210.

In the illustrated embodiment, the plug portion 304, the transition portion 322 and the tube portion 324 are made of elastomeric materials such as unsaturated rubber, saturated rubbers, etc. configured to bend without kinking. In various alternate embodiments, the plug portion 304 and the transition portion 322 may be made of metallic or non metallic materials for example plastic.

Referring to FIG. 5, during assembly of the drop tube 300 and the shunt tank 202, the drop tube 300 is inserted through the inlet port 226 in such a manner that the chamfered end 326 contacts a connecting wall 212 to move towards the bottom wall 206 of the shunt tank 202. Further, the plug portion 304 and the flange 316 abut the insert 232 such that a movement of the drop tube 300 towards the reservoir portion 210 is restricted. Furthermore, the tube portion 324 of the drop tube 300 is partly received within the inlet port 226 and is bent such that the chamfered end 326 is disposed below the average coolant level of the shunt tank 202.

INDUSTRIAL APPLICABILITY

Figure 6:
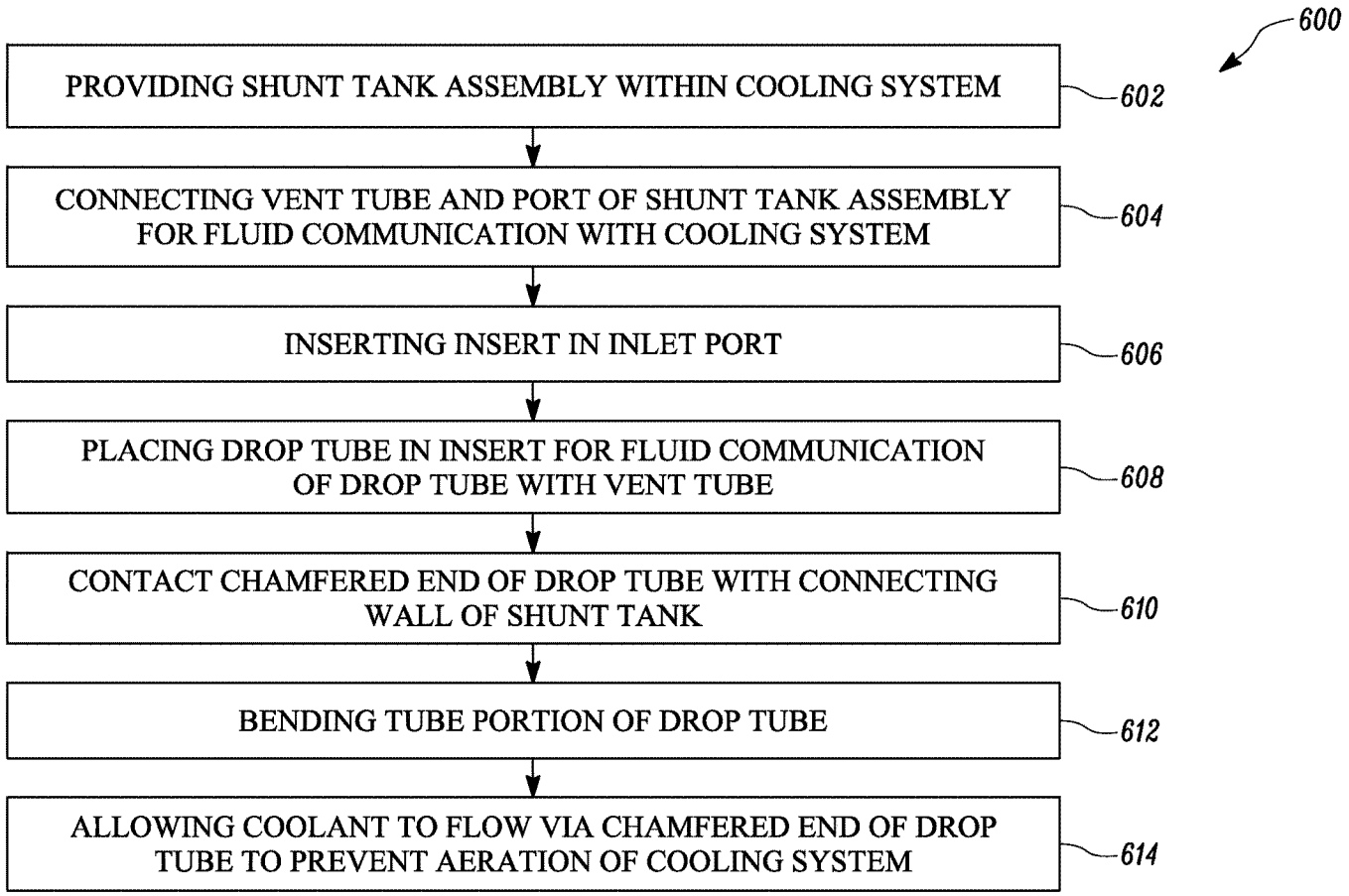
FIG. 6 is a flowchart for a method of preventing aeration in the cooling system, according to an embodiment of the present disclosure.

FIG. 6 illustrates a flow chart of the method 600 of preventing aeration in the cooling system 104, according to an embodiment of the present disclosure. At step 602, the shunt tank assembly 200 is provided within the cooling system 104. The shunt tank assembly 200 is connected with the cooling system 104 such that the shunt tank assembly 200 provides an overflow compartment for compensating volume change of the coolant due to temperature change during operation of the engine system 100. The shunt tank assembly 200 includes the shunt tank 202 and the inlet port 226. The shunt tank 202 includes the reservoir portion 210 that is configured to store the coolant therein. Further, the inlet port 226 allows transfer of the coolant between the shunt tank 202 and other components of the engine system 100.

At step 604, the method 600 includes connecting the vent tube 228 and the inlet port 226 of the shunt tank assembly 200 for fluid communication with the cooling system 104. The vent tube 228 is connected to the inlet port 226 of the shunt tank 202 for transferring the coolant between the shunt tank 202 and other components of the engine system 100. The method 600 further includes connecting the vent tube 228 of the shunt tank assembly 200 with the radiator 108 associated with the cooling system 104. The vent tube 228 is further connected to the inlet manifold 110 of the radiator 108. The vent tube 228 is adapted to transfer a flow of coolant between the inlet manifold 110 of the radiator 108 and the shunt tank 202 based on the positions of the thermostat 120.

At step 606, the method 600 includes inserting the insert 232 in the inlet port 226. In the illustrated embodiment, the insert 232 is inserted within the inlet port 226 such that a transition fit is obtained between the insert 232 and the second projecting portion 209. In an embodiment, the insert 232 may also be coupled to the second projecting portion 209 of the side wall 208A.

At step 608, the method 600 includes placing the drop tube 300 in the insert 232 for fluid communication of the drop tube 300 with the vent tube 228. The plug portion 304 is adapted to be received within the insert 232. The plug portion 304 abuts the insert 232. Further, the flange 316 is adapted to abut the insert 232 such that the movement of the plug portion 304 towards the reservoir portion 210 is restricted. The tube portion 324 is partly received within the insert 232 and extends into the reservoir portion 210 of the shunt tank 202. At step 610, the method 600 includes contacting the chamfered end 326 of the drop tube 300 with the connecting wall 212 of the shunt tank 202.

At step 612, the method 600 includes bending the tube portion 324 of the drop tube 300 such that the chamfered end 326 of the tube portion 324 is disposed below the average coolant level of the shunt tank 202. The drop tube 300 is received within the inlet port 226 in such a manner that the chamfered end 326 contacts the connecting wall 212 to bend the tube portion 324 towards the bottom wall 206 of the shunt tank 202.

At step 614, the method 600 includes allowing the coolant to flow via the chamfered end 326 of the drop tube 300 to prevent aeration of the cooling system 104. When the thermostat 120 is in the first position and the engine 102 is high idling, the coolant level in the shunt tank 202 rises due to increase in flow of the coolant though the engine conduit 119. In other words, the coolant level in the shunt tank 202 may also increase due to increase in pressure head at the coolant pump 116. Thereafter, the radiator 108 receives a flow of coolant from the shunt tank assembly 200 via the drop tube 300. More specifically, while supplying the coolant from the reservoir portion 210 of the shunt tank 202, the chamfered end 326 receives a flow of coolant below an air pocket of the shunt tank 202 thus, preventing air to enter the cooling system 104 when the thermostat 120 moves to the second position from the first position.

With use of the shunt tank assembly 200 and the method 600, the coolant may also be deaerated during operation of the engine system 100. When the thermostat 120 is in the second position, the drop tube 300 allows aerated coolant to flow from the radiator 108 to the shunt tank 202. Thus, allowing air to flow from the radiator 108 to the shunt tank 202 for deaerating the coolant.

Moreover, dimensions of the drop tube 300 may be suitably chosen based on shape and dimensions of the shunt tank 202. For example, the first length 'L1' and the first diameter 'D2' of the plug portion 304, the second length "L2' of the tube portion 324 may be suitably chosen such that the chamfered end 326 is disposed below the average coolant level of the shunt tank 202. Hence, the drop tube 300 may be conveniently retrefittable with an existing shunt tank.

While aspects of the present disclosure have been particularly shown and described with reference to the embodiments above, it will be understood by those skilled in the art that various additional embodiments may be contemplated by the modification of the disclosed machines, systems and methods without departing from the spirit and scope of what is disclosed. Such embodiments should be understood to fall within the scope of the present disclosure as determined based upon the claims and any equivalents thereof.

What is claimed is:

1. A drop tube for a shunt tank, the drop tube defining a channel along a central axis therethrough, the drop tube comprising:

a plug portion having a first length;

a flange provided at a first end of the plug portion;

a transition portion provided at a second end of the plug portion, the transition portion is tapered with respect to the plug portion; and a tube portion extending from the transition portion and terminating with a chamfered end, the tube portion has a second length greater than the first length of the plug portion, the tube portion is made of elastomeric material and configured to bend without kinking, wherein a maximum outer diameter of the tube portion at the chamfered end, which is where coolant exits and/or enters the tube portion, is less than a maximum outer diameter of the flange and a maximum outer diameter of the plug portion, and wherein, in a side view, a sidewall of the chamfered end of the tube portion forms a point as an end-most portion of the chamfered end.

2. The drop tube of claim 1, wherein a ratio of the first length of the plug portion and the second length of the tube portion is at least 1:6.

3. The drop tube of claim 1, wherein the chamfered end is inclined, from a first side of the tube portion to a second side of the tube portion opposite the first side, with respect to the central axis of the channel at an angle defined between 45 degrees to 60 degrees.

4. The drop tube of claim 1, wherein a ratio of the maximum outer diameter of the plug portion and the maximum outer diameter of the tube portion is at least 5:4.

5. The drop tube of claim 1, wherein the maximum outer diameter of the flange is greater than the maximum outer diameter of the plug portion.

6. The drop tube of claim 5, wherein a ratio of the maximum diameter of the flange and the maximum outer diameter of the plug portion is at least 7:5.

7. A shunt tank assembly for a cooling system, the shunt tank assembly comprising:

a shunt tank;

an inlet port provided on the shunt tank, the inlet port is in fluid communication with a vent tube;

an insert disposed in the inlet port; and a drop tube, the drop tube including:

a plug portion received within the insert and having first length;

a flange provided at a first end of the plug portion;

a transition portion provided at a second end of the plug portion, the transition portion is tapered with respect to the plug portion; and a tube portion extending from the transition portion and terminating with a chamfered end, the tube portion has a second length greater than the first length of the plug portion, the tube portion is bent such that the chamfered end is disposed below an average coolant level of the shunt tank, and such that an open face of the tube portion defined by the chamfered end is adjacent to and faces an internal vertical connecting wall of the shunt tank that caused the tube portion to bend as the tube portion is inserted into the shunt tank.

8. The shunt tank assembly of claim 7, wherein a ratio of the first length of the plug portion and the second length of the tube portion is at least 1:6.

9. The shunt tank assembly of claim 7, wherein the plug portion has a first outer diameter.

10. The shunt tank assembly of claim 9, wherein the tube portion has a second outer diameter less than the first outer diameter of the plug portion.

11. The shunt tank assembly of claim 10, wherein a ratio of the first outer diameter of the plug portion and the second outer diameter of the tube portion is at least 5:4.

12. The shunt tank assembly of claim 7, wherein the chamfered end is inclined, from a first side of the tube portion to a second side of the tube portion opposite the first side, at an angle between 45 to 60 degrees.

13. The drop tube of claim 7, wherein a diameter of flange is greater than the first outer diameter of the tube portion.

14. The drop tube of claim 13, wherein a ratio of the diameter of the flange and the first outer diameter of the plug portion is at least 7:5.

15. The shunt tank assembly of claim 7, wherein the plug portion of the drop tube abuts the insert member.

16. A method of preventing aeration in a cooling system, the method comprising:

providing a shunt tank assembly within the cooling system;

connecting a vent tube of the shunt tank assembly and an inlet port provided on a shunt tank of the shunt tank assembly for fluid communication with the cooling system;

inserting an insert in the inlet port;

placing a drop tube in the insert for fluid communication of the drop tube with the vent tube;

contacting a chamfered end of the drop tube with an internal vertical connecting wall of the shunt tank;

bending a tube portion of the drop tube against the internal vertical connecting wall such that a chamfered end of the tube portion is disposed below an average coolant level of the shunt tank and such that an open face of the tube portion defined by the chamfered end is adjacent to and faces the internal vertical connecting wall of the shunt tank, which caused the tube portion to bend; and allowing a coolant to flow via the chamfered end of the drop tube to prevent aeration of the cooling system.

17. The method of claim 16, wherein said connecting further includes connecting the vent tube of the shunt assembly with a radiator associated with the cooling system.

18. The method of claim 16, wherein, in a side view, a sidewall of the chamfered end of the tube portion forms a point as an end-most portion of the chamfered end.

* * * * *